United States Patent [19]

Jacobs et al.

[11] 3,949,899

[45] Apr. 13, 1976

[54] CHILD RESISTANT SLIDING PANEL CONTAINER

[76] Inventors: M. Neal Jacobs, 11809 Randy Lane, Laurel, Md. 20810; Richard Mainzer, 2307 Hillman Place, Bowie, Md. 20715

[22] Filed: Aug. 15, 1974

[21] Appl. No.: 497,692

[52] U.S. Cl. ..... 220/346; 206/1.5

[51] Int. Cl.[2] ..... B65D 43/20

[58] Field of Search ..... 220/345, 348, 346, 347; 206/1.5; 217/62; 229/9, 19

[56] References Cited

UNITED STATES PATENTS

| | | | |
|---|---|---|---|
| 2,325,721 | 8/1943 | Visser | 220/345 |
| 2,338,192 | 1/1944 | Martin | 220/348 |
| 2,365,186 | 12/1944 | Geimer | 220/348 |
| 2,531,737 | 11/1950 | Lyon | 220/348 |

*Primary Examiner*—Ro E. Hart

[57] ABSTRACT

A Child Resistant Sliding Panel supported in a runner by springs, having tabs on the panel which enter into holes in the runner when the panel is pressed to a greater distance then is necessary to pass a barrier which normally restricts the movement if the panel, and a back-up tab on the runner and hole in the runner to further prevent the panel from sliding if the force exerted on the panel further along the runner becomes excessive.

2 Claims, 8 Drawing Figures

CHILD RESISTANT SLIDING PANEL CONTAINER

PRIOR ART

Some containers or cabinet-like structures use sliding panels to allow insertion or removal of materials from them. The ability to move the panel by the operator requires no special degree of dexterity or precision. An adult or child is equally capable of moving the present sliding panel. Thus to prevent entry by young children into containers or other similarly constructed items requiring a sliding panel, the use of key locks, combination locks, chains and related restraints are used. Certain devices to prevent the sliding panel from sliding require a force be applied to move a hook or other related device away from an anchor post. The force is not specific requiring no dexterity or reasoning to accomplish so that children can easily master the technique.

OBJECTS OF THE INVENTION

An object of this invention is to provide a sliding panel which will require a degree of dexterity and precision to thwart a child's efforts to move it without the use of keys, locks, hooks, chains, and related restraints and not interfere with an adult's utilization of the sliding panel. Another object of this invention is to provide a sliding panel which in the resting position (closed) will not move. It is a further object of this invention that an adult would be able to gently press the sliding panel to such an inward degree, past a horizontal barrier protrusion so that the panel would be moveable and slide freely. Still further it is the object of this invention that the sliding panel when pressed inwardly past the horizontal barrier protrusion but to a distance inward in excess of what is necessary to make the panel slide, the panel would relock itself and not allow a free sliding movement.

DESCRIPTION OF THE DRAWINGS

The various features and complete operation of our invention will be fully understood from the following detailed description, throughout which description reference is made to the accompanying drawings, in which.

DETAILED DESCRIPTION

The sliding panel 5 and all other parts of the invention are to be made of a rigid plastic, glass, wood, or other rigid materials so as to give support to the structure and protection to the enclosed objects. The only exception will be the supporting springs 11, which will be of a suitable plastic or other material having sufficient resiliency that it will retain its molded form durably and give support to the panel 5, while still offering durable flexibility.

Figure 1:
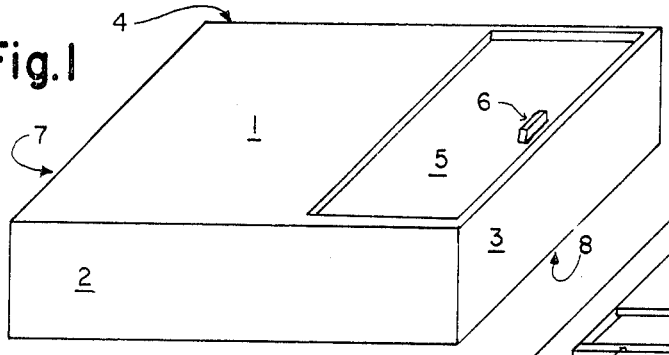
FIG. 1 is an isometric view of a preferred method for the embodiment of our panel by a rectangular receptacle.
Figure 2:
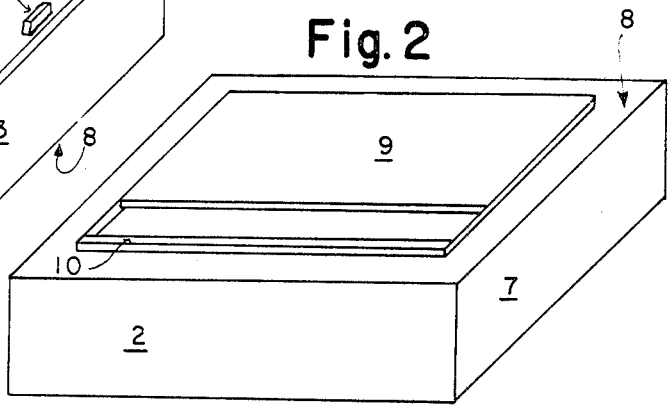
FIG. 2 is an isometric view of the underside of the receptacle as set forth in FIG. 1, incorporating a label holder which will be specified later in the claims. The remaining drawings will depict our invention as incorporated in the same rectangular receptacle for ease of explanation and reference.
Figure 3:
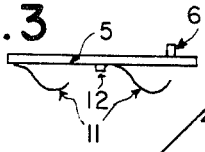
FIG. 3 is a side view of the sliding panel.
Figure 4:
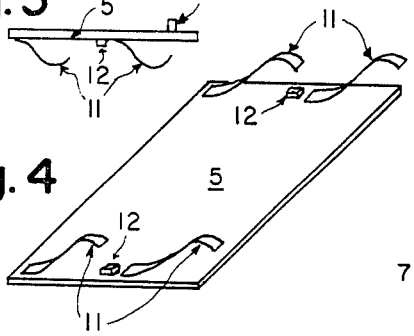
FIG. 4 is an isometric view of the underside of the sliding panel.
Figure 5:
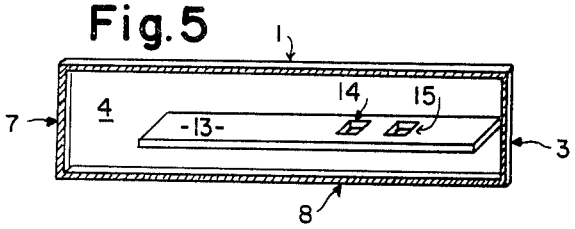
FIG. 5 is an isometric view of one of the two tracks on which the panel rests. It is shown as mounted on the inside of the receptacle.
Figure 6:
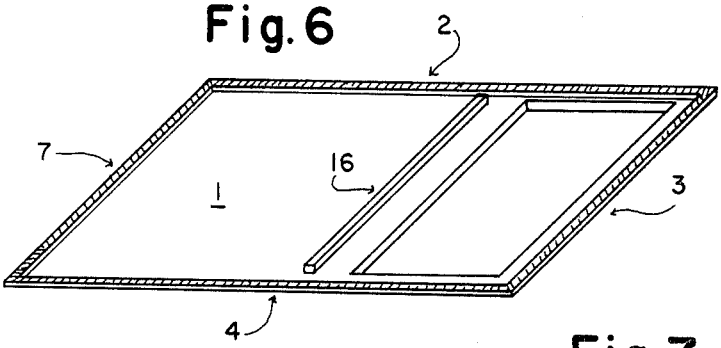
FIG. 6 is an isometric view of the protruding barrier which extends the entire width of the sliding panel. It is shown as mounted on the inside of the receptacle.
Figure 7:
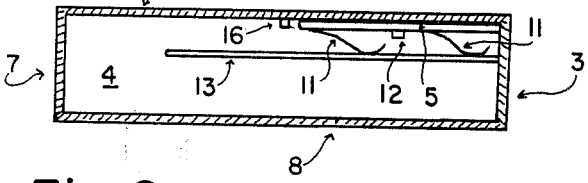
FIG. 7 is a side sectional view of the sliding panel resting in the track. It is shown as mounted on the inside of the receptacle.
Figure 8:
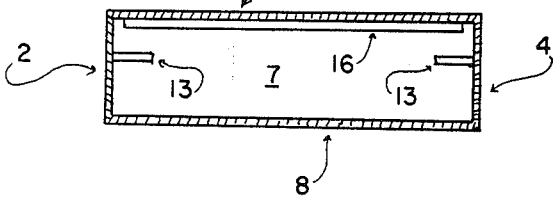
FIG. 8 is a front sectional view of both tracks and the protruding barrier as mounted on the inside of the receptacle.

Positioned on top of the panel 5 toward the posterior end, as seen in FIG. 1, is a tab 6 which serves first, as a means of grasping and sliding the panel 5. Secondly, it serves as a "stop" to prevent the panel 5 from being opened too far, so as to become dislodged from its tracks 13. On the underside of the panel 5 located on opposite edges, as seen in FIG. 4, are two tabs 12. Their function will be explained later. Posterior and anterior to each tab 12 is a supporting spring 11, as seen in FIG. 4. These springs, while resting on the tracks 13, give upward support to the panel 5 keeping it pressed against the top 1 of the receptacle. Located on the tracks 13 are two holes 14, 15, both of larger diameters than the tabs 12 on the underside of the panel 5. Their function will also be explained later. Located on the underside of the panel 5 is a protruding barrier 16 that is positioned very close to the front of the panel 5, as seen in FIG. 7, and extending the entire width of the panel 5, as seen in FIG. 8. This has an essential function in the safety feature of our invention.

The operation of our invention is as follows:

The safety aspect of our invention is evident in the complexity of the manner in which the panel 5 is operated. To slide the panel 5, it is necessary to apply pressure just anterior to the "stop" tab 6, thereby depressing the panel 5 to a depth just below the protruding barrier tab 16 which extends the entire width of the panel 5. If the panel 5 is not depressed to a sufficient depth, the protruding barrier 16 will not permit the sliding of the panel 5 along its tracks 13. The support springs 11 give support to the panel 5 and offer a constant pressure upwards.

Upon depressing the panel 5, if pressure is applied causing the panel 5 to exceed the depth necessary to just clear the protruding barrier 16, the two tabs 12 on the underside of the panel 5 will engage with the holes 15 on both tracks 13. Since the diameters of the holes 15 are greater than the diameters of the tabs 12, the tabs 12 will easily disengage from the holes 15 when the downward pressure on the panel 5 is released. In the event that the tabs 12 do not properly engage with the holes 15, there is a set of backup or secondary holes 14 that will engage with the tabs 12 if the downward pressure is maintained as the panel 5 slides along its tracks 13. Once the panel 5 is depressed to a depth which is sufficient enough to clear the protruding barrier 16, but not to an extent where the two tabs 12 on the underside of the panel 5 will engage with the holes 14, 15 on the tracks 13, the panel 5 may be moved along its tracks 13. Once the panel 5 has passed the protruding barrier 16, the downward pressure may be released and the "stop" tab 6 may be used to grasp the panel 5 and slide it to an open position. The "stop" tab 6 will also act to prevent the panel 5 from sliding too far and possibly becoming dislodged from its tracks 13.

After describing our invention we claim the following:

1. A container comprising a case having a sliding panel closure, which is upwardly supported against the interior surface surrounding the perimeter of a rectangular opening through the use of supporting springs, which are composed of a material of specific resiliency and flexibility so as to offer upward support regardless of the degree of downward pressure exerted on said sliding panel, said springs resting on a rigid runner or track which is inwardly projecting from the interior of said container so as to be perpendicular to said springs and to be at a depth so as to offer sufficient support for the said springs in order to maintain a constant upward pressure on the said sliding panel against the said perimeter of the opening in the said container while the system is at rest, also said sliding panel having small tabs protruding downwardly toward the said runners which upon the administration of excessive downward pressure on said sliding panel, said tabs will engage with corresponding notches or holes in the said runners so as to prevent the lateral movement of said sliding panel under these conditions, also a second notch or hole on said runners just beyond said primary holes so as to prevent the lateral movement of said sliding panel under excessive downward pressure in the event that said tabs do not engage in said primary holes, also an upwardly protruding tab on said sliding panel, of sufficient height so as to prevent said sliding panel from being moved laterally beyond a certain point so as to prevent said springs from disengaging from the said runners, also said upwardly protruding tab would be of sufficient height so as to enable the user of said container to grasp and move said sliding panel laterally, also a downwardly protruding barrier extending the entire width of said sliding panel and protruding to a depth approximately equal to the thickness of said sliding panel so as to restrict the lateral movement of said sliding panel in the absence of any downward pressure.

2. The structure as set forth in claim 1, also a rigid outwardly protruding frame encircling a rectangular surface on the bottom of said container, said frame supporting a transparent rigid surface which will cover approximately three quarters of said encircled surface of said container with sufficient space between the two said surfaces so as to allow the insertion of a label or other graphic material between them, which said frame also acts to prevent the movement of said graphic material from between the two said surfaces.

* * * * *